US009680237B2

(12) United States Patent
Aporius et al.

(10) Patent No.: US 9,680,237 B2
(45) Date of Patent: Jun. 13, 2017

(54) SPRING-FORCE CLAMPING ELEMENT WITH PIVOTING LEVER

(71) Applicant: Weidmueller Interface GmbH & Co. KG, Detmold (DE)

(72) Inventors: Stefan Aporius, Detmold (DE); Constantin Classen, Detmold (DE); Dirk Hanke, Lemgo (DE); Sascha Nolte, Bad Dreiburg (DE)

(73) Assignee: Weidmueller Interface GmbH & Co. KG (DE)

( * ) Notice: Subject to any disclaimer, the term of this patent is extended or adjusted under 35 U.S.C. 154(b) by 0 days.

(21) Appl. No.: 14/782,327

(22) PCT Filed: Apr. 14, 2014

(86) PCT No.: PCT/EP2014/057531

§ 371 (c)(1),
(2) Date: Oct. 4, 2015

(87) PCT Pub. No.: WO2014/170273

PCT Pub. Date: Oct. 23, 2014

(65) Prior Publication Data

US 2016/0049737 A1 Feb. 18, 2016

(30) Foreign Application Priority Data

Apr. 15, 2013 (DE) ..... 20 2013 101 582 U

(51) Int. Cl.
*H01R 4/48* (2006.01)
*H01R 13/633* (2006.01)

(52) U.S. Cl.
CPC ..... *H01R 4/4809* (2013.01); *H01R 4/4836* (2013.01); *H01R 13/633* (2013.01)

(58) Field of Classification Search
CPC ... H01R 4/4836; H01R 3/4827; H01R 4/4818
See application file for complete search history.

(56) References Cited

U.S. PATENT DOCUMENTS 6,126,494 A * 10/2000 Fuchs ..... H01R 4/4845 439/441
6,261,120 B1 * 7/2001 Beege ..... H01R 4/4836 439/268

(Continued)

FOREIGN PATENT DOCUMENTS

DE 1 975 278 U 12/1967
DE 36 37 316 A1 5/1988

(Continued)

*Primary Examiner* — Gary F. Paumen
(74) *Attorney, Agent, or Firm* — Laubscher, Spendlove & Laubscher, P.C.

(57) ABSTRACT

A compact spring-biased connector includes a housing having a chamber containing a conductive bus bar, a clamping spring normally having an expanded clamping condition for biasing a conductor bare end toward electrical engagement with the bus bar, and a release lever pivotally connected with the housing for displacement from a normally closed clamping position toward an open position, such that a lateral projection on the clamping lever operates the clamping spring toward a compressed open condition, thereby permitting removal of the conductor bare end from the housing chamber. The clamping spring is a compression V-shaped leaf spring having a stationary support leg and a movable clamping leg, with the lateral operating projection extending within the chamber to engage the spring clamping leg adjacent its juncture with the support leg.

10 Claims, 5 Drawing Sheets

(56) References Cited

U.S. PATENT DOCUMENTS

| | | | | |
|---|---|---|---|---|
| 7,785,134 | B2 * | 8/2010 | Dhandapani | H01R 4/4818 439/441 |
| 8,129,641 | B2 * | 3/2012 | Majewski | H01R 4/4845 200/335 |
| 8,262,422 | B1 | 9/2012 | Chiang | |
| 8,444,443 | B2 * | 5/2013 | Schafmeister | H01R 4/4836 439/441 |
| 8,794,994 | B2 * | 8/2014 | Kollmann | H01R 4/4836 439/441 |
| 9,124,034 | B2 * | 9/2015 | Kollmann | H01R 4/4836 |

FOREIGN PATENT DOCUMENTS

| | | | |
|---|---|---|---|
| DE | 20 2009 010 003 | U1 | 1/2010 |
| DE | 10 2011 056 410 | A1 | 6/2013 |
| EP | 1 622 224 | B1 | 6/2009 |
| JP | 2003 249 283 | A | 9/2003 |
| JP | 2004 319 394 | A | 11/2004 |
| JP | 2006 012 634 | A | 1/2006 |
| JP | 2012 064 351 | A | 3/2012 |

* cited by examiner

SPRING-FORCE CLAMPING ELEMENT WITH PIVOTING LEVER

REFERENCE TO RELATED APPLICATIONS

This application is a national stage application under 35 C.F.R. §371 of the PCT International Application No. PCT/EP2014/057531 filed Apr. 14, 2014, which claims priority of the German application No. DE 20 2013 101 582.2 filed Apr. 15, 2013.

BACKGROUND OF THE INVENTION

Field of the Invention

The present invention relates to a spring-biased connector including a housing having a chamber containing a conductive bus bar, and a clamping spring normally having an expanded clamping condition for biasing a conductor bare end toward electrical engagement with the bus bar. A release lever is pivotally connected with the housing for displacement from a normal closed clamping position toward an open position, whereby a lateral projection on the clamping lever operates the clamping spring from the expanded clamping condition toward a compressed open condition, thereby to permit removal of the conductor bare end from the housing chamber.

Description of Related Art

It is known in the prior art to provide electrical connectors with spring-biased clamping elements for clamping electrical conductors toward an electrical contact. The electric conductors are solid wire conductors, stranded conductors, or conductive sleeves, for example, in which stranded conductors are clamped, in order to protect the strands from damage. To ensure good electrical conductivity, the wires of the conductor are usually made of a copper-containing material or copper, and are relatively soft as compared to the spring steel used for the clamping springs. In this connection, the miniaturization of the electronics requires ever new installation space-saving concepts.

The Chiang U.S. Pat. No. 8,262,422 B1 discloses a spring-biased clamping element, in which an electric conductor is clamped at a clamping point in a spring housing between a bus bar and a spring arm. The spring arm is pivotable about a fixed axis. To release the electric conductor, the spring arm includes an extension, on the outside of which a connecting piece is provided, which engages in a groove of a lever pivotable about this same axis. As a result, the spring arm with the lever is pivotable against its restoring force and the electric conductor may be removed from the spring housing.

However, the extension of the spring arm of the Chiang patent requires a comparatively wide spring and, therefore, a large installation depth. A very precise guidance of the lever is required, so that the connecting piece does not slip out of the groove. And with the application of force on the outer edge of the extension, there is the risk that the spring will flex toward the outer edge when the lever is actuated, and the actuating force will act unevenly on the spring.

The present invention was developed to provide an alternative spring-force clamping element, which requires less installation space, in particular, less installation depth, ensures proper clamping of an electric conductor in the spring-force clamping element, and allows for an easy opening of the clamping point.

SUMMARY OF THE INVENTION

Accordingly, it is a primary object of the present invention to provide an improved compact spring-biased connector arrangement including a housing having a chamber containing a conductive bus bar, a clamping spring normally having an expanded clamping condition for biasing a conductor bare end toward electrical engagement with the bus bar, and a release lever pivotally connected with the housing for displacement from a normal closed clamping position toward an open position, whereby a lateral projection on the clamping lever operates the clamping spring toward a compressed open condition, thereby to permit removal of the conductor bare end from the housing chamber.

For this purpose, a spring-biased clamping arrangement is provided, including a spring housing having an insertion region for inserting an electrical conductor into the housing chamber, wherein a bus bar and a clamping spring are disposed in the spring housing in such a way that an electric conductor inserted through the insertion region into the spring housing may be clamped at a clamping point between the clamping spring and the bus bar, wherein the spring-force clamping element also includes a pivoting lever, which may be pivoted in a pivot direction about a pivot axis in order to open the clamping point, and which has a lateral operating projection, which presses the clamping spring in the pivot direction when opening the clamping point. A spring-biased clamping element of this type is used preferably as a printed circuit board clamp.

The spring-biased clamping element is distinguished by the fact that the lateral operating projection is disposed between the insertion region of the spring housing and the clamping spring. As a result, the lateral operating projection is disposed in the interior space of the spring housing adjacent the pivot axis of the release lever. Thus, the clamping spring need be designed no wider than is required for the conductor diameter of the electric conductor clamped by the spring-biased clamping element. As a result, the installation thickness of the spring-biased clamping element is adapted to the conductor diameter.

The insertion region of the housing is preferably funnel-shaped or cylindrical-shaped in design. The lateral operating projection is also preferably designed as a contact surface. However, other shapes of the insertion region and/or of the contact geometry are also possible.

It is preferable that the clamping spring includes a clamping leg that is pivotable about the pivot axis of the release lever. It also preferably includes a stationary support leg, which is braced against the spring housing and/or against a cage clamp when the clamping leg is pivoted. The clamping spring is particularly preferably designed as a leaf spring. It is even more preferably made of a spring steel.

In one preferred embodiment, the lateral operating projection is at least partially flat in engagement with the clamping leg, at least when the clamping point is opened. As a result, the force acting on the spring clamping leg is uniformly distributed on the latter in the region of the lateral operating projection. In addition, a lever guide is preferably provided on the spring housing, thereby to guide the lever during its pivotal opening operation. This prevents a twisting of the pivoting lever during opening and safely actuates the clamping spring leg.

The release lever preferably includes a mounting end and an operating end, with the lateral operating projection being disposed between the mounting and operating ends. It has preferably a generally U-shaped design, so that it may be properly and compactly integrated into the construction.

The release lever is preferably mounted at its pivot end, and on its end, is provided with an operating handle.

Alternatively, it could be semi-circular in design. This makes an approximately linear actuation via the actuation angle possible.

In one particularly preferred embodiment, the lateral operating projection is disposed between the release lever ends, and preferably adjacent the mounting end. As a result, an open end of the clamping limb is freely movable when the clamping point is opened, thereby making it easy to remove the electrical conductor.

The pivoting lever is preferably mounted on the axial limb so as to be rotatable about the pivot axis. An actuating surface is also preferably provided on the actuating leg. In this way, the mechanical advantage is proved that lever travel is relatively long and the force required for actuating the clamping limb is relatively minimal. It is preferable that the actuating surface be designed for actuation with or without the use of an actuating tool.

The spring clamping limb preferably includes a first bend at the open end, as well as a second bend adjacent the lateral operating projection. As a result of the second bend, the clamping leg portion between the first bend and the second bend extends virtually transversely to the clamped electrical conductor, respectively. This allows for a low installation height. As a result of the first bend, an obtuse angle is also formed between the clamping limb and the electrical conductor, and the clamped electrical conductor cannot be removed from the spring-biased clamping element and is securely clamped. Moreover, as a result of the first bend, the open end of the clamping leg points in the conductor insertion direction. In this way, the electrical conductor may be inserted into and clamped undamaged in the spring housing.

Also preferably provided on the pivoting lever is a guide support projection, which in an assembled state of the spring-biased clamping element is disposed between the clamping le and the support leg of the clamping spring. Thus, the guide support projection is disposed in the interior chamber of the spring housing and does not increase the installation height. In addition, a guide groove for the clamping spring is formed between the operating later projection and the guide support projection. Moreover, when the clamping leg is pivoted back to its normal position, the release lever is also automatically pivoted back in the opposite direction toward its initial closed clamping position.

BRIEF DESCRIPTION OF THE DRAWINGS

Other objects and advantages of the invention will become apparent from a study of the following specification, when viewed in the light of the accompanying drawing, in which.

DETAILED DESCRIPTION OF THE INVENTION

Figure 1:
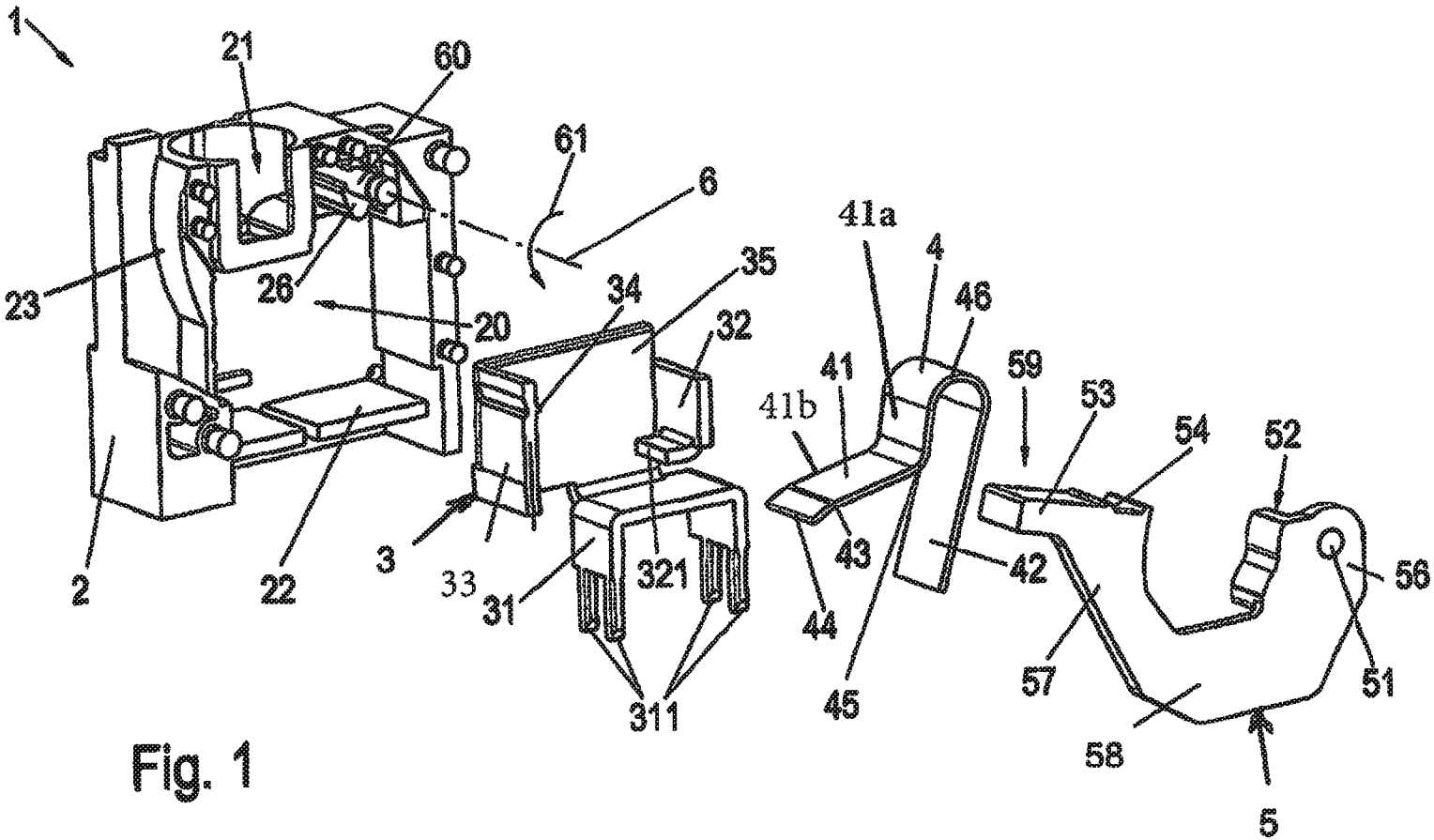
FIG. 1 is an exploded perspective view of the spring-biased clamping connector of the present invention.

Referring first more particularly to FIG. 1 as an overview, the connector arrangement 1 of the present invention includes a housing 2 formed of a non-conductive synthetic plastic material, and includes a vertical bottom wall and side walls cooperating to define a chamber 20 in which are mounted a conductive cage member 3 and a clamping spring 4. As shown in FIGS. 2*c* and 2*f*, the front of the chamber is partially closed by a release lever 5 that is pivotally connected with the housing by a pivot shaft 60. An access opening 21 is provided in the side walls of the housing to permit the bare end of an insulated conductor 8 to be inserted into and removed from the housing chamber 20. The conductor 8 can be a single-wire conductor, or a braided wire conductor. In the case of a braided wire conductor, a protective funnel-shaped conductive support sleeve 7 is provided for introducing the bare conductor end into the housing chamber 20.

The conductive cage member 3, has a generally U-shaped configuration including a vertical rear wall 35 adjacent the chamber bottom wall, and a pair of vertical side walls 32 and 33. The side wall 32 is provided with a lower support ledge 321, and the side wall 33, which serves as a bus bar, is provided with a contact rib 34. The cage 3 includes a lower contact portion 31 having a horizontal wall that is seated on a horizontal cross-support 22 on the housing 2, and a plurality of pin contacts 311 that extend downwardly and outwardly from the housing.

Figure 2A:
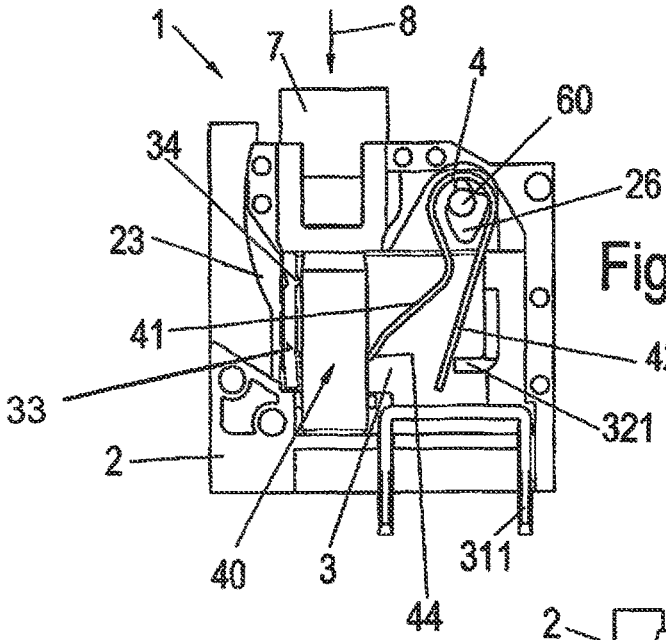
FIGS. 2*a*-2*c* are front elevation views of the apparatus with certain parts removed.
Figure 2B:
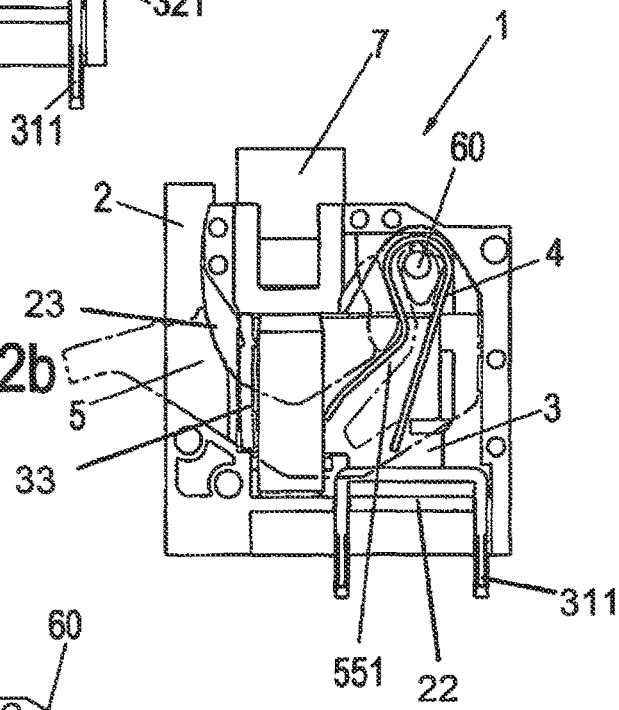
Figure 2C:
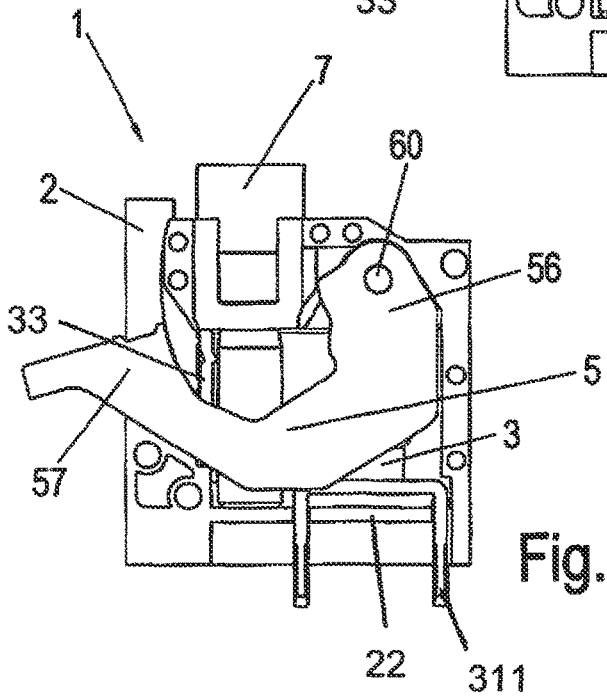
Figure 2D:
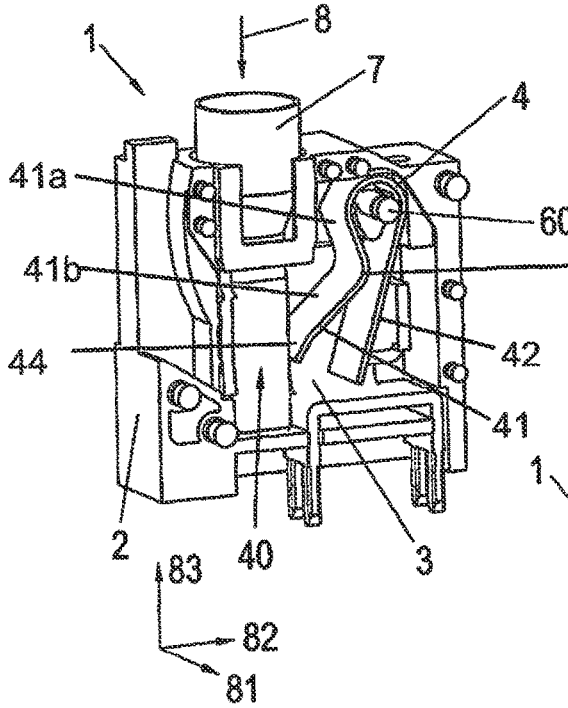
FIGS. 2*d*-2*f* are corresponding front perspective views.
Figure 2E:
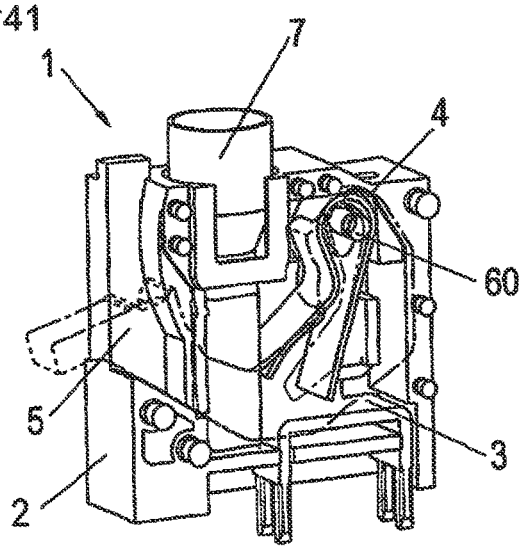
Figure 2F:
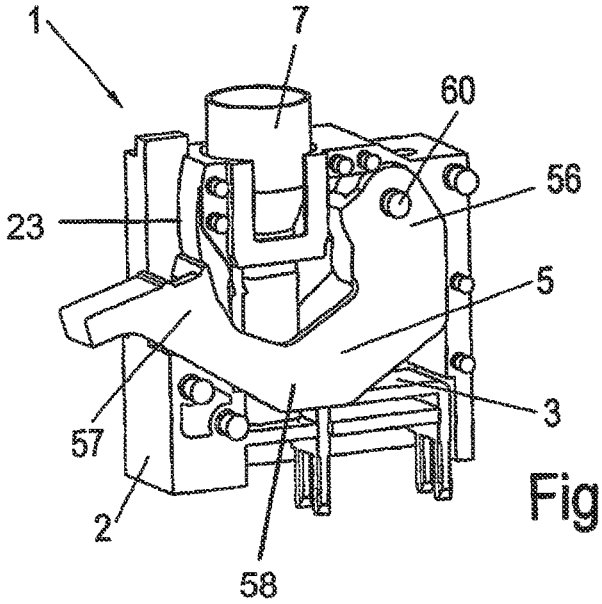

As shown in FIGS. 2*a*-2*e*, the clamping spring 4, which is formed from spring steel or the like, is a compression spring having a generally inverted V-shaped configuration defining a clamping leg 41 joined to a support leg 42 by a connecting portion 46. The connecting portion 46 is supported by the enlarged portion 26 of a horizontal pivot shaft 60 the rear end of which is connected with the bottom wall of the housing chamber 20. As best shown in FIGS. 2*a* and 2*b*, the spring support leg 42 abuts the support ledge 321 on the cage side wall 32. The spring clamping leg 41 contains a first bend 45 that defines leg portions 41*a* and 41*b* that are arranged at an obtuse angle, and a second bend 43 that defines a terminal tab 44 at the end of the clamping leg portion 41*b*. The terminal tab portion 44 of the spring clamping leg 41 normally engages the conductor support sleeve 7 and biases the same toward conductive engagement with the bus bar 33.

Figure 4A:
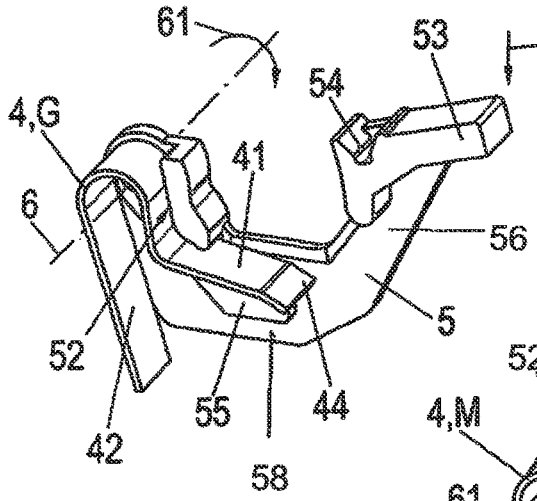
FIGS. 4*a*-4*d* are detailed rear perspective views of the release lever arrangement.
Figure 4B:
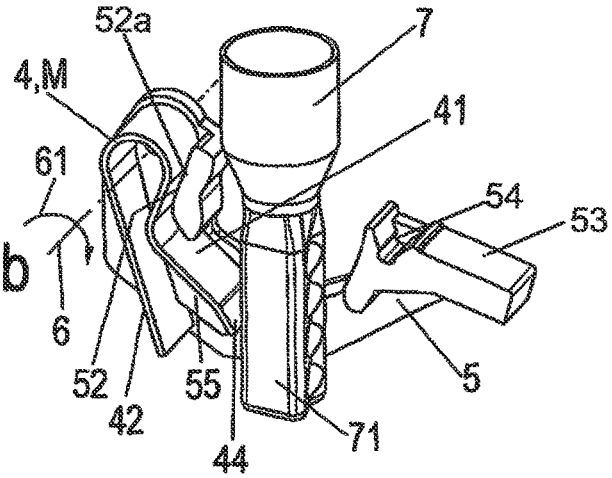
Figure 4C:
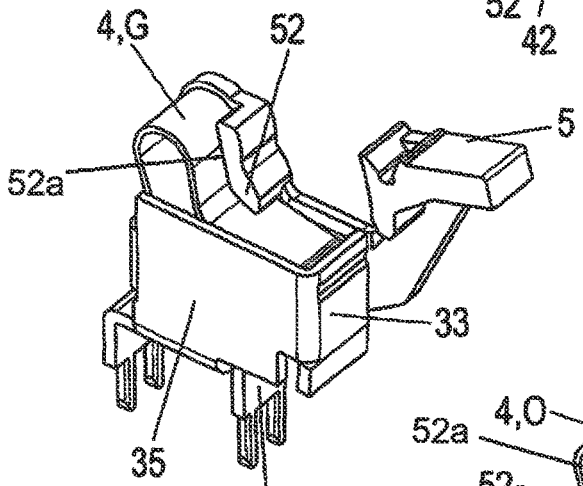
Figure 4D:
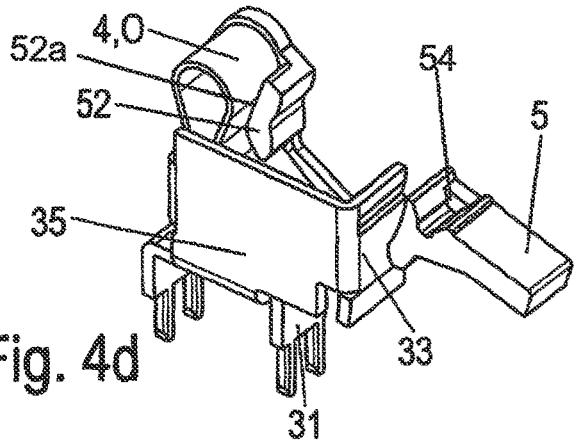

The release lever 5 has a generally U-shaped configuration, and includes a mounting leg 56 and an operating leg 57 joined by a connecting portion 58. The mounting leg 56 contains a pivot opening 51 by means of which the release lever is pivotally supported on the pivot shat 60 for pivotal movement about the fixed pivot axis 6. The mounting arm 56 carries the lateral operating projection 52 that engages the clamping leg portion 41*a*, as best shown in FIGS. 4*a*-4*c*. The operating leg 57 carries the handle portion 53 which contains an operating recess 54 for receiving an operating tool, such as the tip of a screwdriver.

Figure 3A:
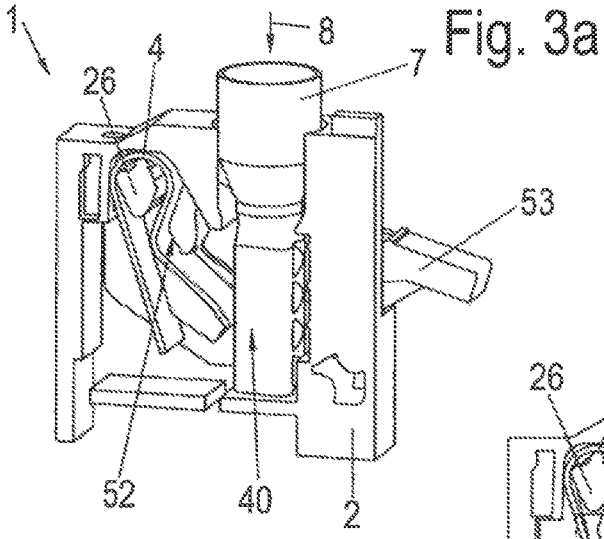
FIGS. 3*a* and 3*b* are rear perspective and rear elevation views, respectively of the invention with certain parts removed.
Figure 3B:
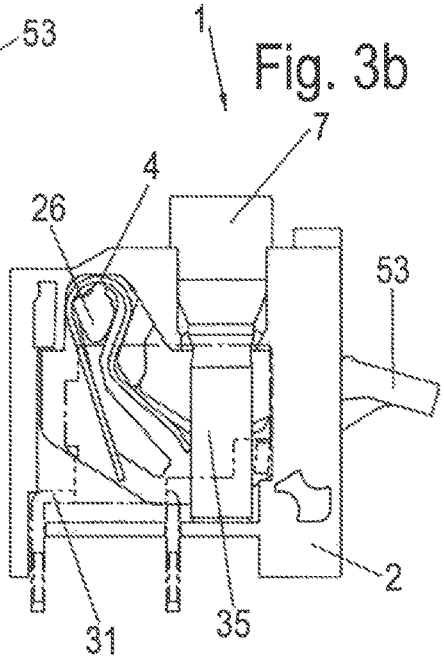
Figure 3C:
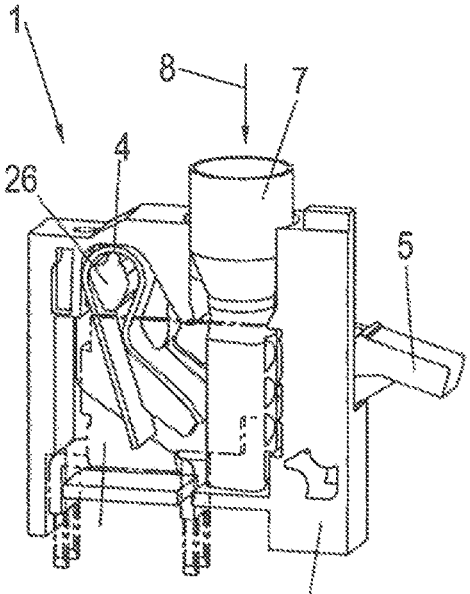
FIGS. 3*c* and 3*d* are rear perspective and rear elevation views of the invention with certain parts removed.
Figure 3D:
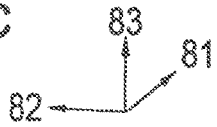
Figure 3D:
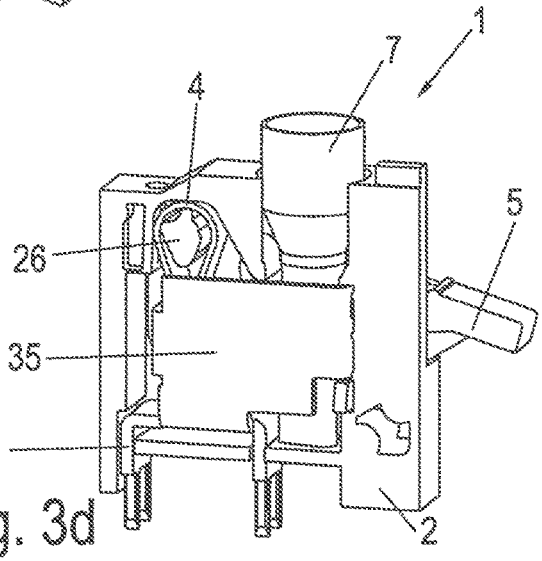

The clamping spring 4 is normally in the unstressed expanded clamping condition shown in FIGS. 1, 3*a* and 4*a*, whereupon the release lever 5 is in its initial closed clamping position with the spring clamping leg biasing the conductor sleeve 7 toward conductive engagement with the bus bar 33. The conductor 8 is thus connected with the pin terminals 311 for soldered connection with the desired distribution conductors (not shown). To open the connector for insertion and removal of the conductor sleeve 7 and the conductor 8, the user applies—either manually or by an operating tool—a downward force 59 (FIG. 4*a*) to the handle portion 53, thereby to pivot the release lever 5 in the direction 61 of FIG. 1. The lateral operating projection 52 applies pressure to the spring clamping leg portion 41*a* to compress the clamping spring and thereby displace the tab extremity 44 away from the conductor support sleeve 7, thereby to permit removal of the sleeve and the conductor from the housing 2. Upon removal of the opening force 59, the clamping spring expands to it normal unstressed condition, and the clamping leg 41 pivotally returns the release lever to its initial closed position.

Referring again to FIG. 1, the cage clamp 3 is accessible through an insertion region 21 provided in the spring housing 2. The spring housing 2 is preferably made of an electrically insulating material, preferably a synthetic plastic material, and may be designed as part of a primary housing, for example, of a terminal block. The cage clamp 3 is preferably made of an electrically well-insulating metal, preferably of a copper-containing metal or of copper.

Provided adjacent to the insertion region 21 is the pivot shaft 60 having an enlarged profile portion 26 supporting the clamping spring 4. Here, the V-shaped clamping spring 4 is designed as a leaf spring. It includes a clamping leg 41 and a support leg 42, which are connected to one another by an approximately semicircular connecting portion 46. The clamping spring 4 is preferably manufactured from spring steel.

The clamping spring 4 is guided around the holding contour 26 in the region of the connecting portion 46. The pivot shaft 60, designed in approximately the center of the cross limb 46, extends concentrically about the pivot axis 6 and forms a pivot shaft. In this way, the spring clamping leg 41 is pivotable about the pivot axis 6.

The preferably U-shaped cage clamp 3 includes a bus bar 33, which is disposed transversely to a rear wall 35 of the cage clamp 3. A side wall 32, on which a support piece 321 is provided, is formed opposite the bus bar 33 transversely to the rear wall 35.

During a pivoting movement of the spring clamping leg 41 in a pivot direction 61 about the pivot axis 6, the support leg 42 of the clamping spring is braced against the support piece 321. In this process, the clamping leg 41 is pivoted in the pivot direction 61 against the restoring force of the clamping spring 4.

Also provided on the cage member 3 is an integral connecting piece 31 on which, in this case, four connector pins 311 are provided for connection with electric conductors (not shown). The connector pins 311 shown here are designed as solder pins. Other connectors are also possible, however, for example, a contact spring or a contact pin or differently designed connectors, which allow for soldering, clamping, inserting or the like. The configuration of the connecting piece 31, of the connector pins 311 or other connectors is selected in accordance with the existing installation space.

The cage member 3 may be inserted into the interior space 20 of the spring-force clamping element 1 above a cross piece 22 of the spring housing 2. When the cage clamp 3 is inserted, the connector pins 311 are guided outwardly, so that the interior space 20 remains free for the clamping spring 4 and an electric conductor support sleeve 7 (see FIG. 2) inserted into the spring housing 2. Furthermore, the connector pins 311 are accessible from the outside as a result.

Once the spring-biased connector 1 is assembled, the electric conductor support sleeve 7 may be inserted between the spring clamping leg 41 and the bus bar 33. In the assembled position M (see FIGS. 2, 3), the electric conductor is forced by the clamping leg 41 opposite the pivot direction 61 against the bus bar 33 at a clamping point 40, indicated here by an arrow. The electric conductor support sleeve 7 shown here is, for example, a sleeve, in which a stranded or braided conductor is normally inserted. The spring-biasing element may, however, also be used without a sleeve for a stranded conductor and for a solid wire conductor.

A release lever 5 is provided, in order to release the electric conductor 7 from the spring-biased connector and to remove the conductor in a direction opposite to the conductor insertion direction. With the release lever 5, it is possible not only to release the electric conductor 7 from the spring-force clamping element 1. Rather, the pivoting lever 5 is also provided for opening the clamping point 40. It therefore allows the clamping point 40 to be opened before an electric conductor 8, in particular, a thin-wire electric conductor 8, is to be clamped in the spring-biased clamping arrangement 1. With the clamping point 40 opened, it is very easy to insert the electric conductor sleeve 7—or the conductor 8 directly—into the clamping point 40.

The base portion 58 of the release lever 5 in this case is approximately U-shaped in design. FIGS. 4*b* and *d* illustrate that the U-shaped cage 3 of the pivoting lever are advantageously situated opposite one another, such that they form a kind of closed contour, which encompasses an inserted conductor, wherein the release lever 5 remains pivotable. At its mounting end 56, the release lever is disposed on the pivot shaft 60 and is mounted so as to be rotatable about the pivot axis 6. For this purpose, a through-hole 51 is provided, which extends concentrically about the pivot axis 6, and which is mounted so as to be rotatable on the pivot shaft 60. Differently shaped release levers 5, for example, a semicircular or a V-shaped release lever 5, are also conceivable.

In addition, the operating leg 57 of the release lever 5 also includes an actuating handle portion 53. The pivoting lever 5 may be actuated manually at the actuating handle 53. In addition, a recess 54 for an actuating tool (not shown) is provided so that there, too, the release lever 5 may be actuated using the actuating tool, for example, a screw driver. Instead of an actuating handle 53, however, a more compact actuating surface 53 is preferred, which allows only one actuation using an actuating tool.

To be able to actuate the clamping leg 41 with the pivoting lever 5, so that the clamping point 40 is opened and the clamped electric conductor 7 may be inserted into the spring-biased arrangement 1 or may be removed again from the spring-force clamping element 1, a lateral operating projection contact geometry 52 is provided between the mounting leg 56 and the operating leg 57. In the assembled spring-biased clamping element 1, the lateral operating projection 52 is disposed between the clamping limb 41 and the insertion region 21. As a result, it is disposed in the interior space 20 of the spring-biased connector arrangement 1 and does not increase the installation depth of the arrangement.

When the release lever 5 is pivoted about the pivot axis 6 in the pivot direction 61, the lateral operating projection 52 presses on the clamping limb 41. As a result, the clamping leg 41 is also pivoted about the pivot axis 6 in the pivot direction 61.

The lateral operating projection 52 has a flat design and fits at least partially flat against the clamping leg 41, at least when opening the clamping point 40, i.e., when pivoting the release lever 5 in the pivot direction 61. As a result, the force is evenly distributed on the clamping leg 41 in the region of the lateral operating projection 52. Moreover, it does not break as a result when actuating the pivoting lever.

Due to the restoring force of the clamping spring 4, the clamping leg 41 is automatically pivoted back opposite the pivot direction 61 when the electric conductor sleeve 7 is removed from the spring-biased connector 1, and the release lever 5 is no longer acted upon by any actuating force. The clamping leg 41 at this point fits partially against the lateral operating projection 52 and presses on the projection 52 opposite the pivot direction 61, so that the release lever 5 is pivoted back by the clamping spring 4.

Also provided on the release lever 5 is a guide projection contour 55 (FIG. 4*a*), which in the assembled state of the spring-biased connector 1 is disposed between the clamping leg 41 and the support leg 42. As a result, a guide groove 551 (see FIG. 2*b*) is formed between the lateral operating projection 52 and the guide projection 55, in which the clamping leg 41 is safely guided when pivoted.

A lever guide arrangement 23 is provided on the housing 2, so that the installation depth of the spring-biased connector 1 is not increased unnecessarily by the release lever 5. During pivoting, the release lever 5 is guided along the lever guide 23. The lever guide arrangement 23 also prevents the release lever 5 from freely pivoting when the electric conductor sleeve 7 is connected.

In order to limit the installation height of the spring-biased connector 1, and to create a good holding force on the inserted electric conductor sleeve 7, the clamping leg 41 includes a first bend 43 and a second bend 45.

The first bend 43 is provided at an open end 44 of the clamping limb 41. The second bend 45 is provided in the region of the contact geometry 52. As a result of the second bend 45, the clamping limb 41 between the first bend 43 and the second bend 45 extends virtually transversely to the clamped electric conductor 7, respectively, the conductor insertion direction 8. The installation height is minimal as a result. As a result of the first bend 43, an obtuse angle is formed between the clamping limb 41 and the electric conductor 7, and securely clamps the conductor in the spring-force clamping element 1. The direction of the installation depth 81, the installation width 82 and the installation height 83 are shown in FIGS. 2 and 3.

To open the clamping point and to release an electric conductor 7 clamped in the spring-force clamping element 1, requires an actuating force on the actuating handle 53 or the recess 54 at the open end 59 of the actuating leg 57 of the pivoting lever 5, which acts in the conductor insertion direction.

FIGS. 4 (*a*) and (*c*) show a base position G of the clamping spring 4, in which no electric conductor 7 is inserted in the spring housing 2. In this base position, the clamping leg 41 extends approximately transversely to the conductor insertion direction.

FIG. 4 (*b*) shows an assembly position M of the clamping spring 4, in which an electric conductor sleeve 7 is inserted into the spring housing 2 and clamped in said housing between the open end 44 of the clamping leg 41 and the bus bar 33. The electrically conductive end of the sleeve 7 is identified here by the reference numeral 71.

FIG. 4(*d*) shows an open position O of the clamping spring 4, in which the clamping leg 41 and the release lever 5 are pivoted as far as possible in the pivot direction 61. This open position O is possible, only if the actuating force acts on the release lever 5 in the conductor insertion direction. The actuating force is shown here by an arrow 9. However, it is also preferable to provide catch means (not shown) in the spring-force clamping element 1, so that the release lever 5 is locked in place in the open position O.

While in accordance with the provisions of the Patent Statutes the preferred forms and embodiments of the invention have been illustrated and described, it will be apparent to those skilled in the art that changes may be made without deviating from the invention described above.

What is claimed is:

1. A spring-biased connector for connecting the bare end of an electrical conductor with a bus bar, comprising:

(a) a housing (2) formed of non-conductive synthetic plastic material and including a vertical bottom wall, and side walls cooperating with said bottom wall to define a chamber (20), one of said side walls containing an access opening (21) through which the conductor bare end is introduced into said housing chamber;

(b) a stationary conductive bus bar member (33) mounted in said housing chamber;

(c) a clamping spring (4) mounted in said housing chamber, said clamping spring being a compression spring normally having an expanded clamping condition biasing the conductor bare end toward electrical engagement with said bus bar; and (d) a release lever (5) for operating said clamping spring from said expanded clamping condition toward a compressed open condition, thereby to permit removal of the conductor bare end from the housing chamber, said release lever including:

(1) a mounting end (56) pivotally connected with said housing to provide pivotal movement of said lever about a horizontal pivot shaft (60) secured at one end to said housing bottom wall, thereby to define a fixed horizontal pivot axis (6);

(2) an operating end (57); and (3) a lateral operating projection (52) mounted on said release lever adjacent said lever mounting end, said lateral operating projection extending into said chamber for engagement with said clamping spring such that:

(a) when said clamping spring is in said released expanded clamping condition, said release lever is in an initial closed clamping position;

(b) said release lever being pivotally displaceable in a first direction (61) about said pivot axis from said closed clamping position toward an open position in which said lateral operating projection causes said clamping spring to be in said compressed open condition;

(e) said clamping spring comprising a generally V-shaped inverted leaf spring having a support leg (42), a clamping leg (41), and a connecting portion (46) connecting together corresponding ends of said support and clamping legs, said clamping spring connecting portion being mounted within said housing chamber on said pivot shaft with said support and clamping legs extending downwardly therefrom, said clamping leg containing a bend (45) defining a flat first clamping leg portion (41*a*) adjacent said spring connecting portion, and a second clamping leg portion (41*b*) arranged at an obtuse angle relative to said first clamping leg portion;

(f) and further wherein said release lever lateral operating projection includes a flat surface (52*a*) in contiguous engagement with said first clamping leg portion.

2. The spring-biased connector as defined in claim 1, wherein said release lever includes a lateral support projection (55) arranged to support said second clamping leg portion when said release lever is pivoted from said closed clamping position toward said open position.

3. The spring-biased connector as defined in claim 1, wherein said release lever is generally U-shaped and includes an intermediate portion (58) connected between said lever mounting end and said lever operating end, and further wherein said lever second end terminates in a handle portion (53).

4. The spring-biased connector as defined in claim 3, wherein said handle portion contains a recess (54) for receiving an operating tool.

5. The spring-biased connector as defined in claim 1, wherein said pivot shaft includes a support portion (26) on which said clamping spring connecting portion is mounted.

6. The spring-biased connector as defined in claim 3, wherein said housing includes a guide arrangement (23) for guiding said release lever during the pivot displacement thereof between said lever open and closed positions.

7. The spring-biased connector as defined in claim 1, wherein said bus bar is integral with and defines one leg of a U-shaped cage member (3) mounted within said housing chamber, said cage member including a plurality of contact pins (311) extending outwardly from said housing chamber.

8. The spring-biased connector as defined in claim 7, wherein said release lever extends across said housing chamber to close the same.

9. The spring-biased connector as defined in claim 1, wherein said clamping spring includes a further bend (43) defining at the end of said second leg portion a reversely bent terminal portion (44) adapted to engage the conductor.

10. The spring-biased connector as defined in claim 9, wherein the conductor is formed as a braided wire; and further including a tubular sleeve member (7) enclosing the bare end of the braided wire conductor.

* * * * *